US005393068A

United States Patent [19]

Kane

[11] Patent Number: 5,393,068

[45] Date of Patent: Feb. 28, 1995

[54] BOMBARDIER GAME WITH HOUSING FOR SIGHTING A TARGET AND SUPPORTING RELEASABLE BOMBS

[76] Inventor: Ronald E. Kane, 11226 Cherryhill Rd. #103, Beltsville, Md. 20705

[21] Appl. No.: 215,099

[22] Filed: Mar. 21, 1994

[51] Int. Cl.[6] ..... A63B 67/00

[52] U.S. Cl. ..... 273/351

[58] Field of Search ..... 273/351, 346, 416, 419, 273/420, DIG. 30

[56] References Cited

U.S. PATENT DOCUMENTS

| | | | |
|---|---|---|---|
| 1,912,925 | 6/1933 | Wallace | 273/351 X |
| 2,359,383 | 10/1944 | Pitts | 273/351 |
| 2,452,817 | 11/1948 | Whipple et al. | 273/351 |
| 3,032,345 | 5/1962 | Lemelson | 273/346 |
| 4,819,947 | 4/1989 | Mackey | 273/412 |
| 5,016,891 | 5/1991 | Nelson | 273/407 |
| 5,082,291 | 1/1992 | Appel et al. | 273/346 |
| 5,096,211 | 3/1992 | Morais | 273/420 |
| 5,165,694 | 11/1992 | Kraushaar | 273/343 |

FOREIGN PATENT DOCUMENTS

| | | | |
|---|---|---|---|
| 1097040 | 2/1955 | France | 273/351 |

*Primary Examiner*—William H. Grieb

[57] ABSTRACT

A bombardier game with housing for sighting a target and supporting releasable bombs comprising a housing formed in a generally rectangular configuration which has a rear end with holes to be held adjacent the eyes of the player and a laterally extending forty-five degree mirror for functioning as a periscope for looking downward to the target therebeneath. The housing also has a remote end with a plurality of apertures for receiving a plurality of bombs to be dropped. The housing also has triggers with springs with the lower ends of the triggers in contact with the bombs supported within the apertures. The triggers have upper exposed ends to be pulled by the player to release an associated bomb with the spring adapted to urge its associated trigger into the locking position against its associated bomb.

1 Claim, 4 Drawing Sheets

BOMBARDIER GAME WITH HOUSING FOR SIGHTING A TARGET AND SUPPORTING RELEASABLE BOMBS

BACKGROUND OF THE INVENTION

1. Field of the Invention

The present invention relates to bombardier game with housing for sighting a target and supporting releasable bombs and more particularly pertains to striking a target with bombs from a sighting device with a mirror for sighting purposes.

2. Description of the Prior Art

The use of games of skill and chance is known in the prior art. More specifically, games of skill and chance heretofore devised and utilized for the purpose of directing objects toward a target are known to consist basically of familiar, expected, and obvious structural configurations, notwithstanding the myriad of designs encompassed by the crowded prior art which has been developed for the fulfillment of countless objectives and requirements.

By way of example, Mackey U.S. Pat. No. 4,819,947 discloses an aerial projectile game apparatus.

Nelson U.S. Pat. No. 5,016,891 discloses a projectile-target game apparatus.

Appel et al U.S. Pat. No. 5,082,291 discloses a projectile and target game apparatus.

Morais U.S. Pat. No. 5,096,211 discloses a dart game apparatus.

Lastly, Kraushaar U.S. Pat. No. 5,165,694 discloses a projectile and target game.

In this respect, the bombardier game with housing for sighting a target and supporting releasable bombs according to the present invention substantially departs from the conventional concepts and designs of the prior art, and in doing so provides an apparatus primarily developed for the purpose of striking a target with bombs from a sighting device with a mirror for sighting purposes.

Therefore, it can be appreciated that there exists a continuing need for new and improved bombardier game with housing for sighting a target and supporting releasable bombs which can be used for striking a target with bombs from a sighting device with a mirror for sighting purposes. In this regard, the present invention substantially fulfills this need.

SUMMARY OF THE INVENTION

In view of the foregoing disadvantages inherent in the known types of games of skill and chance now present in the prior art, the present invention provides an improved bombardier game with housing for sighting a target and supporting releasable bombs. As such, the general purpose of the present invention, which will be described subsequently in greater detail, is to provide a new and improved bombardier game with housing for sighting a target and supporting releasable bombs and method which has all the advantages of the prior art and none of the disadvantages.

To attain this, the present invention essentially comprises a target having a lower surface positionable on the ground and having an upper surface with indicia designating the area to be stuck by bombs. A plurality of bombs which have a flat lower extent of a pile type fastener and an upwardly extending rod with radially extending veins for allowing the straight line dropping of the bombs to the target. A housing is formed in a generally rectangular configuration which has a rear end with holes to be held adjacent the eyes of the player and a laterally extending forty-five degree mirror for functioning as a periscope for looking downward to the target therebeneath. The housing also has a remote end with a plurality of apertures for receiving a plurality of bombs to be dropped. The housing also has triggers with springs with the lower ends of the triggers in contact with the bombs supported within the apertures. The triggers have upper exposed ends to be pulled by the player to release an associated bomb with the spring adapted to urge its associated trigger into the locking position against its associated bomb.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved bombardier game with housing for sighting a target and supporting releasable bombs which have all the advantages of the prior art games of skill and chance and none of the disadvantages.

It is another object of the present invention to provide new and improved bombardier game with housing for sighting a target and supporting releasable bombs which may be easily and efficiently manufactured and marketed.

It is further object of the present invention to provide new and improved bombardier game with housing for sighting a target and supporting releasable bombs which are of durable and reliable constructions.

An even further object of the present invention is to provide new and improved bombardier game with housing for sighting a target and supporting releasable bombs which are susceptible of a low cost of manufacture with regard to both materials and labor, and which accordingly are then susceptible of low prices of sale to the consuming public, thereby making such bombardier game with housing for sighting a target and supporting releasable bombs economically available to the buying public.

Still yet another object of the present invention is to provide new and improved bombardier game with housing for sighting a target and supporting releasable bombs which provide in the apparatuses and methods of the prior art some of the advantages thereof, while simultaneously overcoming some of the disadvantages normally associated therewith.

Even still another object of the present invention is to striking a target with bombs from a sighting device with a mirror for sighting purposes.

Lastly, it is an object of the present invention to provide a new and improved bombardier game with housing for sighting a target and supporting releasable bombs comprising a housing formed in a generally rectangular configuration which has a rear end with holes to be held adjacent the eyes of the player and a laterally extending forty-five degree mirror for functioning as a periscope for looking downward to the target therebeneath. The housing also has a remote end with a plurality of apertures for receiving a plurality of bombs to be dropped. The housing also has triggers with springs with the lower ends of the triggers in contact with the bombs supported within the apertures. The triggers have upper exposed ends to be pulled by the player to release an associated bomb with the spring adapted to urge its associated trigger into the locking position against its associated bomb.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
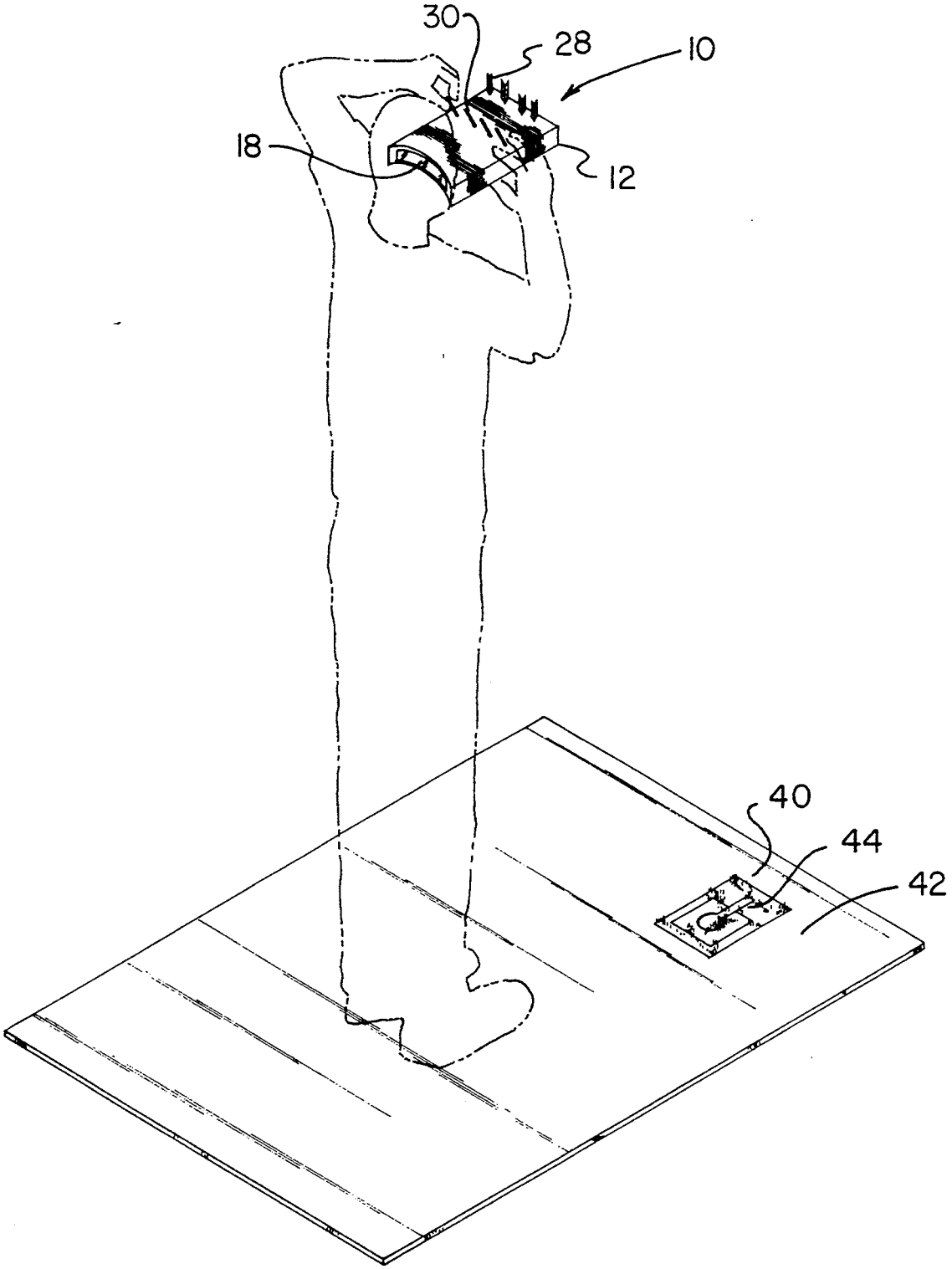
FIG. 1 is a perspective illustration of the preferred embodiment of the bombardier game with housing for sighting a target and supporting releasable bombs constructed in accordance with the principles of the present invention.
Figure 2:
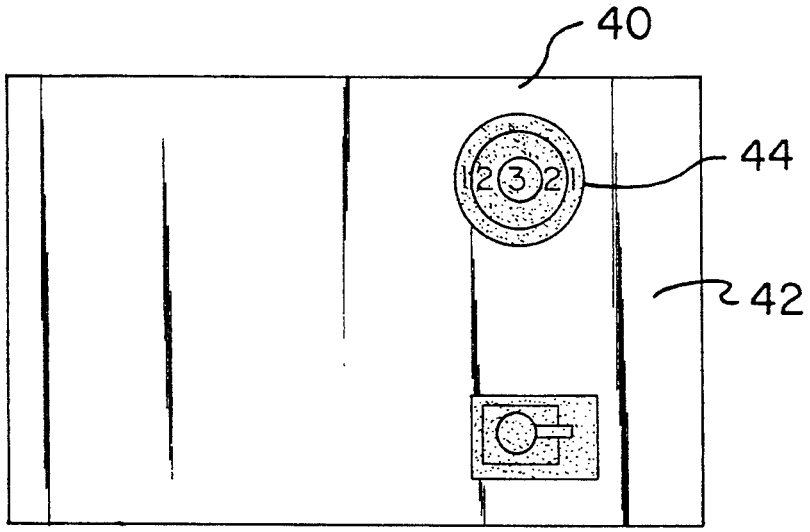
FIG. 2 is a plan view illustrating the target as shown in FIG. 1.
Figure 3:
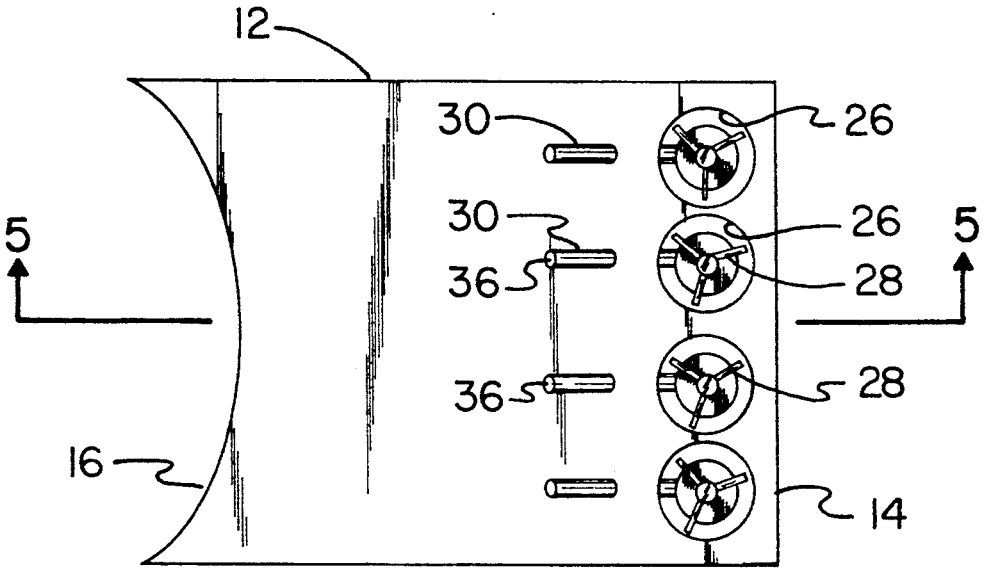
FIG. 3 is a plan view illustrating the housing as shown in FIG. 1.
Figure 4:
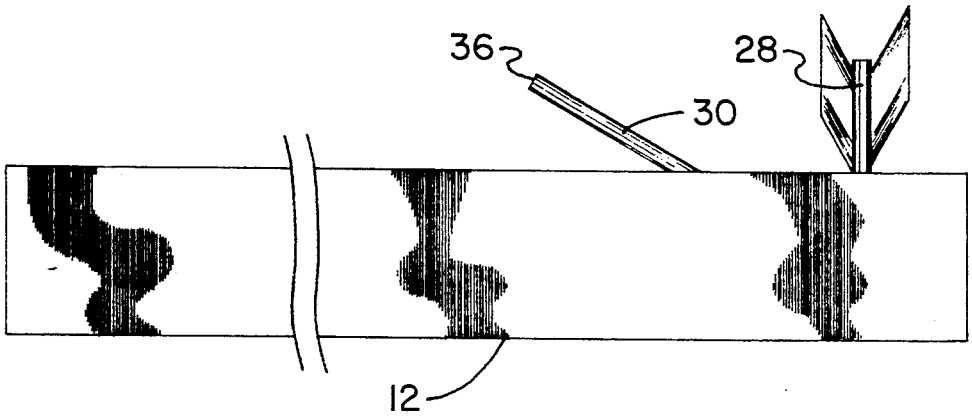
FIG. 4 is a side elevational view of the housing shown in FIGS. 1 and 3.
Figure 5:
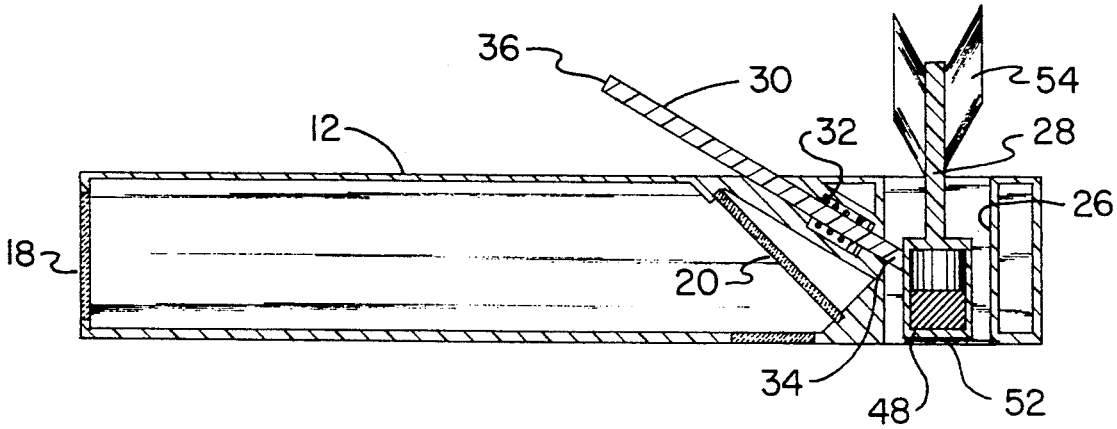
FIG. 5 is a sectional view taken centrally through the housing of FIG. 4.
Figure 6:
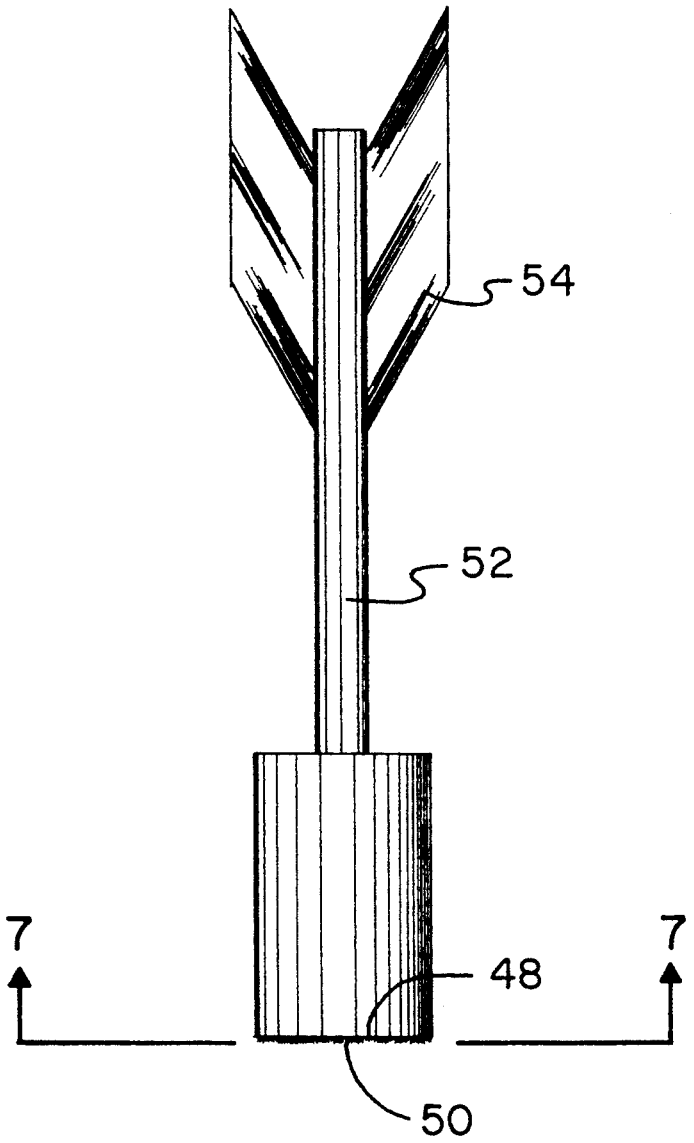
FIG. 6 is a side elevational view of one of the bombs shown in FIG. 1.
Figure 7:
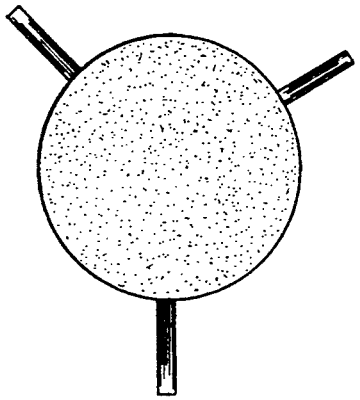
FIG. 7 is a bottom elevational view taken along line 7—7 of FIG. 1.

With reference now to the drawings, and in particular to FIG. 1 thereof, the preferred embodiment of the new and improved bombardier game with housing for sighting a target and supporting releasable bombs embodying the principles and concepts of the present invention and generally designated by the reference numeral 10 will be described.

The present invention, the new and improved bombardier game with housing for sighting a target and supporting releasable bombs is comprised of a plurality of individual components. In their broadest context, such components include a housing, a target and bombs. The individual components are specifically configured and correlated with respect to each other so as to achieve the intended objective.

More specifically, the housing 12 is formed of a container in a generally rectangular configuration. It has a flat front end 14 positionable away from the user. It also has a concavely curved rear end 16 opposite from the front end. The rear end is provided with a hole 18 to be held adjacent to the eyes of a user. Spaced a distance from the eye holes in a central extent from the housing is a mirror 20. The mirror is laterally disposed in a generally horizontal orientation at about 45 degrees with respect to the horizontal and vertical. In this manner, the housing and mirror function as a periscrope. This allows a player to look horizontally through the eye holes and his line of sight will be deflected 45 degrees by the mirror so as to looking forwardly will allow the user to look downwardly to the target therebeneath.

The front end 14 has, adjacent thereto, a plurality of apertures 26 extending therethrough. The apertures are for supporting a plurality of bombs 28 be dropped. In association with that are a plurality of triggers 30. Each trigger is provided with an associated spring 32. Consequently, there is for each bomb, an associated aperture, trigger and spring. The lower end 34 of the triggers are adapted to be in contact with the bombs when the bombs are supported within the apertures. The triggers also have upper exposed ends 36. The exposed ends are adapted to be pulled by the player to release its associated bomb with the associated spring adapted to urge its associated trigger into locking position against the associated bomb. As such, pulling the trigger releases the locking contact between the trigger and bomb to allow the bomb to drop downwardly toward the target after it has been released.

The next component of the system is the target 40. The target is a flat sheet having a lower surface positionable on the ground or other recipient surface. The target also has an upper surface 42. The upper surface is formed with indicia 44, designating the intended area to be struck by bombs during the play of the game. Lastly provided are the bombs 28 themselves. Each bomb has a flat lower extent 48. The lower extent is formed with a pile type fastener 50. This is for effecting a locking action between the bomb and the target when contact is made after the bomb is dropped. Also as part of each bomb is an upwardly extending rod 52. The rod has radially extending vanes 54. The veins function to allow for the straight line dropping of the bombs from the housing to the target during operation and use.

The present invention is a novel target practice game. Its main purpose for the user is to score as many points as possible while walking over a target simulating flight. Points are received for successfully bombing objects on a VELCRO mat. It is an exciting war game for both children and adults alike. The present invention is both fun and also an educational device for children. First it teaches a child to visually look through a periscope device and focus on an object, developing a younger child's control and concentration. Additionally, the targets on the mat are very colorful, allowing a child to become easily familiarized with colors. The present invention is safe for children ages three and up since there are no hard or sharp objects to hurt themselves. Another advantage of this game is that there is no limit as to the number of players.

The game utilizes a device similar to a periscope, a VELCRO floor mat, and VELCRO bombs. The periscope is rectangular in shape and measures two inches wide, six inches high, and eight inches long. It is of typical construction, with a mirror tilted at a forty-five degree angle, and a sight positioned in the viewing window. The simple bomb release mechanism, located behind and parallel to the mirror, is a small plastic pin with a spring released mechanism and must be pulled to drop the bomb sitting in the tube. The bombs have a VELCRO tip which stick to the VELCRO mat. The latter is three feet long and two feet wide. Despite the simplicity of the game, it is fun and very entertaining to play.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved bombardier game with housing for sighting a target and supporting releasable bombs comprising, in combination:

a target having a lower surface positionable on the ground and having an upper surface with indicia designating the area to be struck by bombs;

a plurality of bombs having a flat lower extent of a pile type fastener and an upwardly extending rod with radially extending veins for allowing the straight line dropping of the bombs to the target; and a housing formed in a generally rectangular configuration having a rear end with holes and a curved surface to be held adjacent the eyes of the player and a laterally extending forty-five degree mirror for functioning as a periscope for looking downward to the target therebeneath, the housing also having a remote end with a plurality of apertures for receiving a plurality of bombs to be dropped, the housing also having triggers with springs with the lower ends of the triggers having angled front frictional surfaces in contact with the bombs supported within the apertures to hold the bombs at their sides solely by friction, the triggers having upper exposed ends to be pulled by the player to release an associated bomb with the spring adapted to urge its associated trigger into the locking position against its associated bomb.

* * * * *